US007416494B2

(12) United States Patent
Edel

(10) Patent No.: US 7,416,494 B2
(45) Date of Patent: Aug. 26, 2008

(54) PUTTER WITH INTERCHANGEABLE FACEPLATE

(76) Inventor: David M Edel, 45171 State Hwy. 38, Reedsport, OR (US) 97467

( * ) Notice: Subject to any disclaimer, the term of this patent is extended or adjusted under 35 U.S.C. 154(b) by 0 days.

(21) Appl. No.: 11/623,385

(22) Filed: Jan. 16, 2007

(65) Prior Publication Data

US 2007/0111813 A1 May 17, 2007

Related U.S. Application Data

(63) Continuation-in-part of application No. 11/037,856, filed on Jan. 18, 2005, now Pat. No. 7,163,465.

(60) Provisional application No. 60/537,216, filed on Jan. 16, 2004.

(51) Int. Cl.
*A63B 53/06* (2006.01)

(52) U.S. Cl. ..... 473/288; 473/340

(58) Field of Classification Search ..... 473/288, 473/340, 341; 411/553, 549, 552
See application file for complete search history.

(56) References Cited

U.S. PATENT DOCUMENTS 1,253,700 A 1/1918 McLaughlin
1,599,336 A 9/1926 Lindgren
2,201,638 A * 5/1940 Theibault, Sr. ..... 473/245
2,386,552 A 10/1945 Hill
3,368,812 A 2/1968 Baldwin
3,547,445 A 12/1970 Hardesty
3,893,670 A 7/1975 Franchi
4,121,832 A 10/1978 Ebbing
4,618,149 A 10/1986 Maxel
4,884,808 A 12/1989 Retzer
5,275,413 A * 1/1994 Sprague ..... 473/337
5,362,047 A 11/1994 Shaw et al.
5,437,447 A * 8/1995 Rigutto ..... 473/251
5,445,386 A 8/1995 Marshall
5,509,660 A 4/1996 Elmer
5,597,362 A * 1/1997 Lee et al. ..... 473/244
5,863,257 A 1/1999 Busnardo
6,203,443 B1 * 3/2001 Britton ..... 473/244
6,270,423 B1 * 8/2001 Webb ..... 473/226
6,506,126 B1 * 1/2003 Goodman ..... 473/245
6,817,953 B2 11/2004 Farmer

* cited by examiner

*Primary Examiner*—Stephen L. Blau
(74) *Attorney, Agent, or Firm*—Gonzales Patent Services; Ellen Gonzales

(57) ABSTRACT

A putter-fitting system that allows for quick and easy alteration of various aspects of the putter including, but not limited to, weighting, lie angle, and hosel style is described. Also described are a cam-based putter face release mechanism, a cam-based hosel release mechanism and/or an interchangeable striking surface insert.

13 Claims, 7 Drawing Sheets

PUTTER WITH INTERCHANGEABLE FACEPLATE

PRIORITY CLAIM

The present application is a continuation-in-part of U.S. patent application Ser. No. 11/037,856, filed Jan. 18, 2005, which claims priority from the benefit of U.S. Provisional Patent Application No. 60/537,216, filed Jan. 16, 2004, the entirety of which is hereby incorporated by reference.

BACKGROUND OF THE INVENTION

Golf has become increasing popular through the years, and as a result more and more golfers are purchasing custom fit golf clubs. Custom fitting may be performed by a golfing professional, a fitting professional, or by a golf store employee. Many different fitting techniques can be employed to find golf clubs that are best suited to a particular golfers needs. One golf club for which a professional fitting has become increasingly popular is the putter. Putters can be customized in a large number of ways. For example, putters are available in a number of different styles offering different shaft lengths, different grips, different weighting in the club head and differently sized and shaped heads. However, more subtle alterations can have profound effects on a golfer's putting success as well. For example, alterations in the club face loft or style of hosel can significantly impact a golfer's feel for the putter. When custom fitting a putter to a golfer, it is desirable to allow a golfer to try out as many different putters as possible. Therefore, it is desirable to provide putters and putter-fitting systems that allow for quick and easy alteration of the putter being tried.

SUMMARY OF THE INVENTION

The present invention is related to the field of golf clubs. More particularly the present invention is related to apparatus for the custom fitting of golf clubs. Specifically, the present invention provides a putter and putter-fitting system that allows for quick and easy alteration of various aspects of the putter including, but not limited to, weighting, loft, and hosel style.

DETAILED DESCRIPTION OF THE INVENTION

The present invention provides a putter and putter fitting system that allows for quick and easy alteration of various aspects of the putter face including weighting, loft and hosel style. In one aspect, the putter comprises several component parts that can be removed, replaced and then seamlessly connected together to provide a fully functioning putter.

Figure 1:
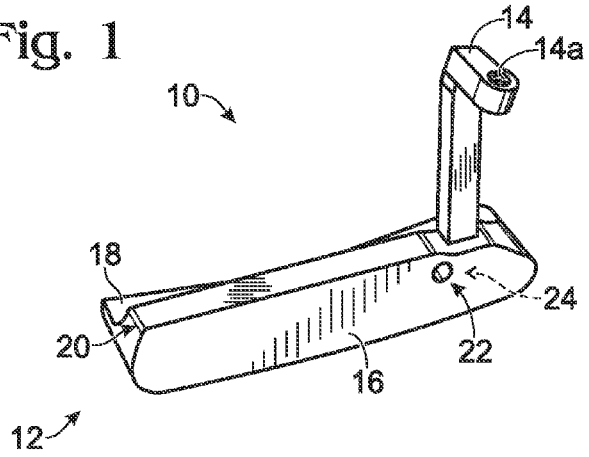
FIG. 1 is a front view of a putter according to a first embodiment of the present invention.

FIGS. 1-6 depict a first embodiment of the present invention. FIG. 1 is a front view of a putter 10. Putter 10 includes a putter head 12 connected to a hosel 14. It will be appreciated by those of skill in the art that while not shown, a putter shaft would typically be connected to hosel 14, for example at orifice 14*a*, when the putter is in use. As shown, putter head 12 includes a face portion or plate 16 and a rear or body portion 18. Face portion 16 includes an upper lip 20 that extends rearwards and fits flush against rear portion 18 to form a seamless striking surface as well as a seamless transition from the striking surface to the upper surface. Face portion 16 further includes an orifice 22, which provides access to hosel release mechanism 24, which is described in greater detail below.

Figure 2:
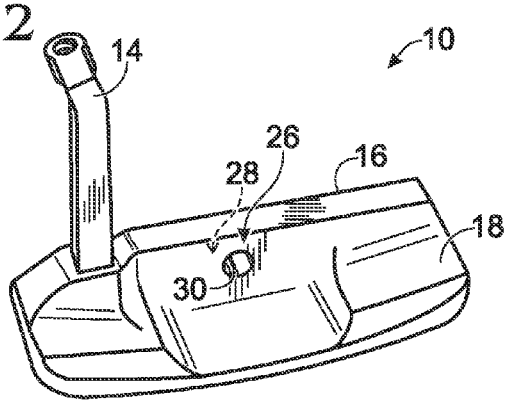
FIG. 2 is a rear view of the putter of FIG. 1.

FIG. 2 provides a better view of rear portion 18. As shown, rear portion 18 includes an orifice 26, which provides access to face portion release mechanism 28, which is also described in greater detail below. A cam 30, seen in greater detail in FIG. 3, is seated within orifice 26 and, in FIG. 2, is just barely visible within orifice 26.

Figure 3:
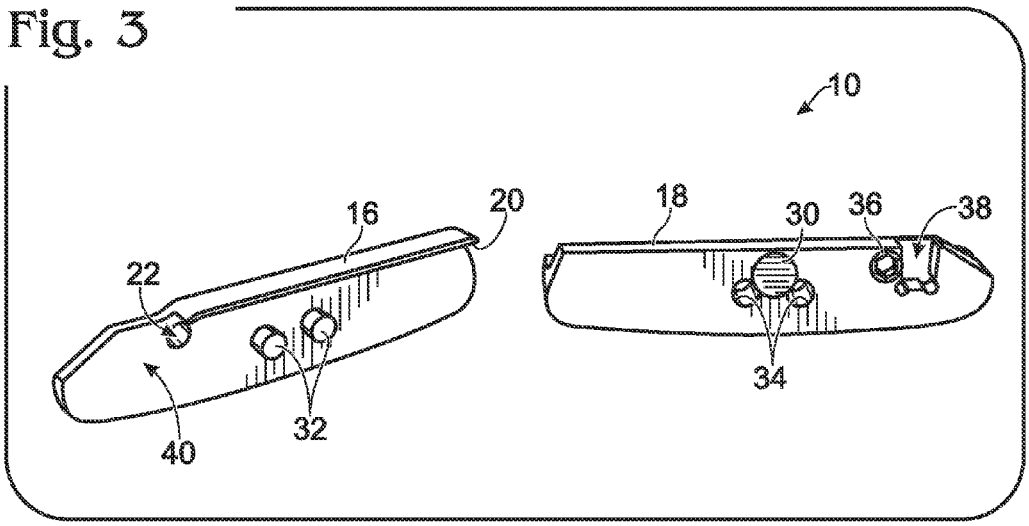
FIG. 3 depicts the putter of FIG. 1 where the face portion has been separated from the rear portion.

FIG. 3 depicts face portion 16 separated from rear portion 18. It is noted that the hosel has been removed and is not shown in FIG. 3. Upper lip 20 is clearly visible in this figure. As stated above, upper lip 20 provides a seamless surface for putter 10. A seamless surface particularly on the striking surface and upper portion of the club is desirable because golf clubs in general, and putters in particular, tend to be subjected to a significant amount of wear and tear during normal use. This wear and tear can result in various parts of the club becoming dented or malformed. Any malformation may make it more difficult for the various components parts to seat together seamlessly, thereby disrupting the various aspects of the golf club that have been carefully engineered to provide a specific result when striking the ball.

As stated above, putter 10 may include a face portion release mechanism. According to one embodiment, the face portion release mechanism may be cam-based. As previously described rear portion 18 may include cam 30 seated in orifice 26. As shown in FIG. 3, face portion 16 may include detents 32. When detents 32 are inserted into orifices 34 in rear portion 18, the detents are able to be engaged and disengaged by cam 30, thereby securing the face and rear portions of putter 10 to each other.

This cam-based face-plate engagement mechanism provides a fast and easy way to remove one face plate and exchange it with another. This provides for an extremely efficient fitting process. Alternatively, this allows the owner of the club to change the face plate characteristics, or replace a damaged face plate, without having to resort to using or purchasing an entirely different putter. It will be appreciated that the face portion release mechanism may be designed to be significantly more difficult to release, for example by requiring a specific, uncommon tool to effect release of the putter face, in order to conform the club to USGA rules for tournament play. Such design is contemplated by the scope of the present disclosure.

Moreover, as previously described, putter 10 may include a hosel release mechanism. According to one embodiment, the hosel release mechanism may be cam-based. Thus, in the depicted embodiment, a second cam 36 is shown seated within rear portion 18. Cam 36 is able to engage and disengage hosel 14 when the hosel is inserted into a recess 38. The fourth side of recess 38 is provided by the inner surface 40 of putter face portion 16. Thus, recess 38 is fully formed when face portion 16 and rear portion 18 are joined together. As with the cam-based face plate engagement mechanism, the cam based hosel engagement mechanism provides for a fast and easy way to quickly and efficiently remove and exchange various hosels. However, again, it is contemplated that the release mechanism may be designed so that it is significantly more difficult to operate so as to conform the club to USGA tournament rules.

Figure 4:
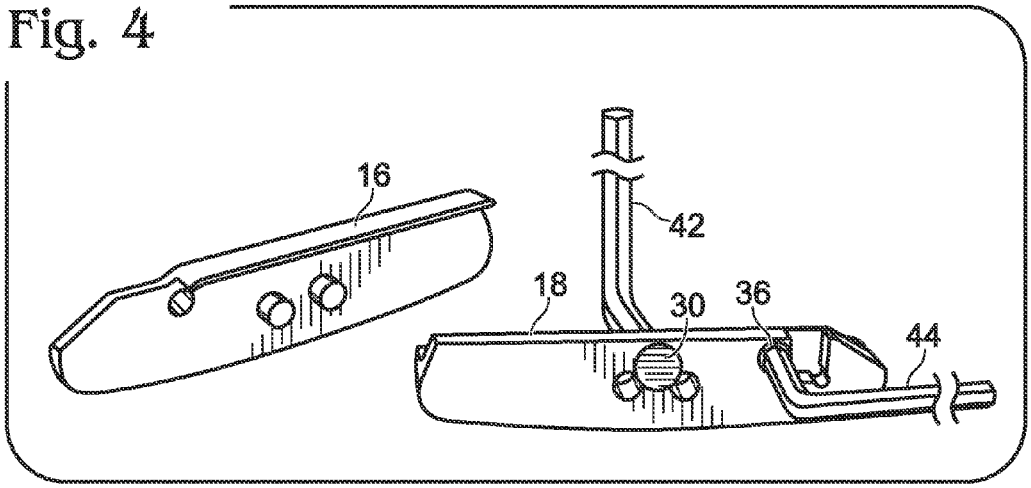
FIG. 4 depicts the putter of FIG. 1 with the face portion separated and showing the cams being rotated.

As mentioned above, cam 30 secures face portion 16 and rear portion 18 together, forming putter head 12. Cam 36 secures hosel 14 to putter head 12. Returning briefly to FIGS. 1 and 2, it can be seen that cam 30 is accessible via orifice 26 (FIG. 2) and cam 36 is accessible via orifice 22 (FIG. 1). Any suitable tool may be used to rotate the cams within their respective shafts, including for example, Allen wrenches, screw drivers, etc. FIG. 4, shows Allen wrenches 42 and 44 being used to rotate cams 30 and 36, respectively. It will be appreciated that the cams should include an appropriate engagement surface for the type of tool that will be used. Therefore, in the depicted example, cams 30 and 36 include hexagonal indentures suitable for receiving the end of an Allen wrench.

Figure 5:
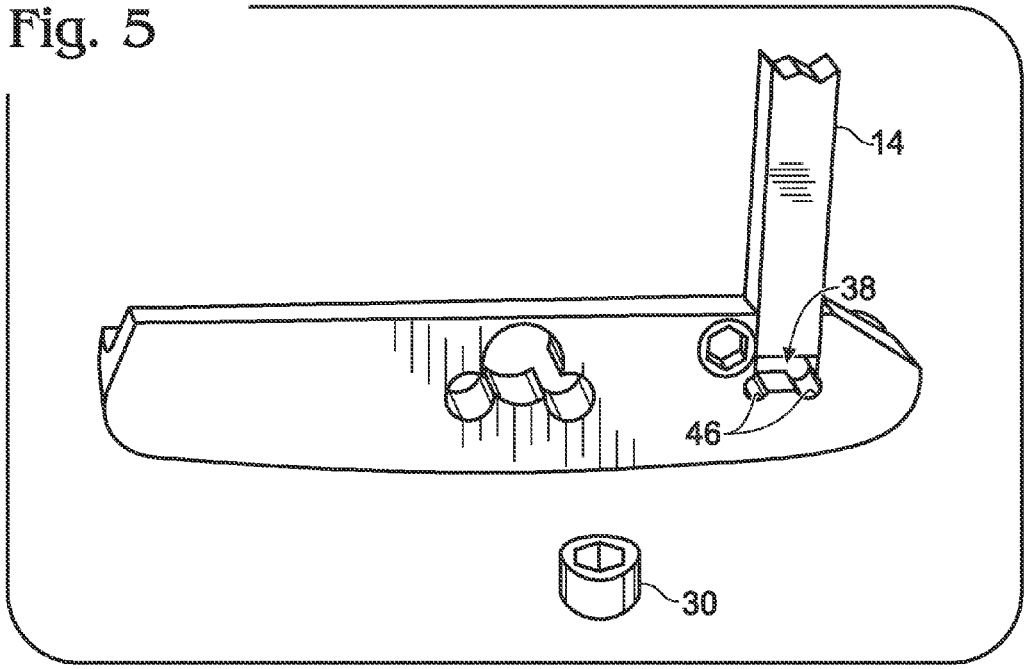
FIG. 5 depicts the rear portion of the putter of FIG. 1 as a hosel is being inserted into the putter head.
Figure 6:
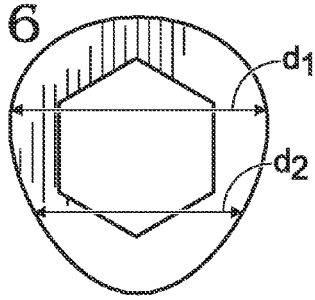
FIG. 6 is an isolation, close-up view of a cam suitable for use in the putter of FIG. 1.

FIG. 5 depicts hosel 14 being inserted into recess 38. Because most hosels have a square or rectangular terminal surface and it is important that the hosel seat securely in recess 38, the recess has been formed into a rectangle. This may be accomplished, for example, by pre-drilling two small holes (the residual portions of which can be seen at 46) at the lower limit of the intended recess and then using a larger bit to drill down to the holes.

In the presently described embodiment, face portion release mechanism 28 includes cam 30 and detents 32. As shown in FIG. 5 and in greater detail in FIG. 6, cam 30 may be formed to have an irregular shape which allows the cam to present a broader diameter d1 or narrower diameter d2 to detents 32. The irregular shape of cam 30 allows the cam to securely engage detents 32 when the cam is rotated such that the broader diameter d1 is seated between the detents and disengage detents 32 when the cam is rotated such that the narrower diameter d2 is seated between the detents.

Figure 7:
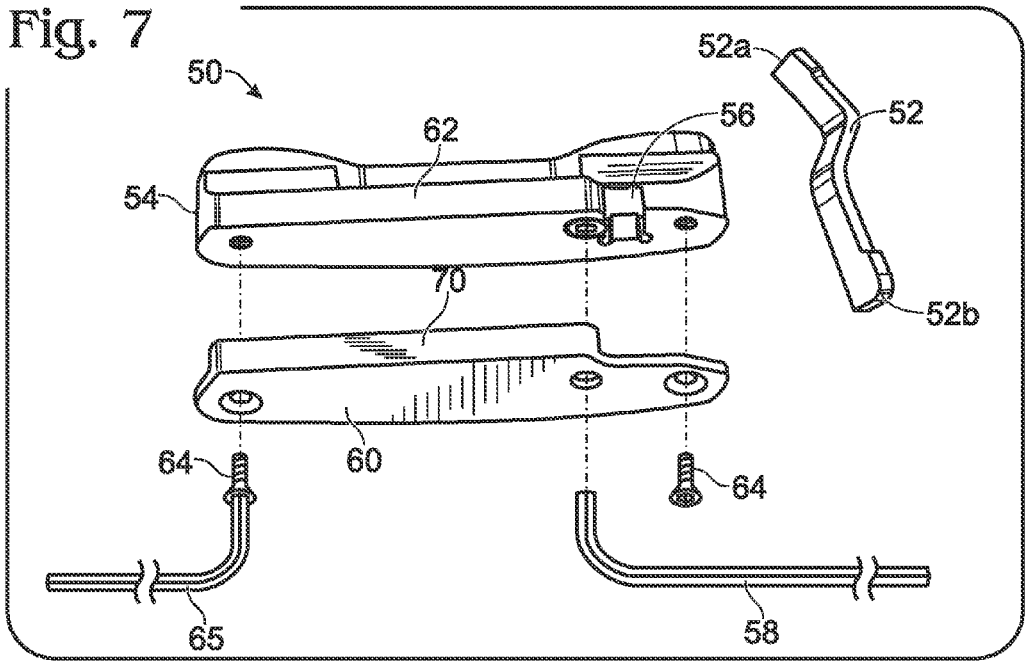
FIG. 7 is an exploded view of a putter according to another embodiment of the present invention.

A second embodiment of the present invention is shown in FIG. 7. The depicted putter 50 includes a detachable (or interchangeable) hosel 52, to which a shaft (not depicted) would attach at point 52*a*. The detachable hosel can be removably affixed to club head 54 by inserting end 52*b* into orifice 56. Once inserted into the orifice, the hosel can be locked into place by rotating an internal cam by using an Allen wrench 58 (or other suitable device.)

Club head 54 may be formed of a face portion 60 and a rear portion 62. Face portion 60 may be removably (or interchangeably) mated to rear portion 62 via screws 64. A wrench 65, or other suitable tool, may be used to tighten screws 64.

As shown, face portion 60 further includes an upper lip 70 which is configured to align with the side and upper surfaces of rear portion 62 so as to present a smooth outward appearance.

Figures 9, 10:
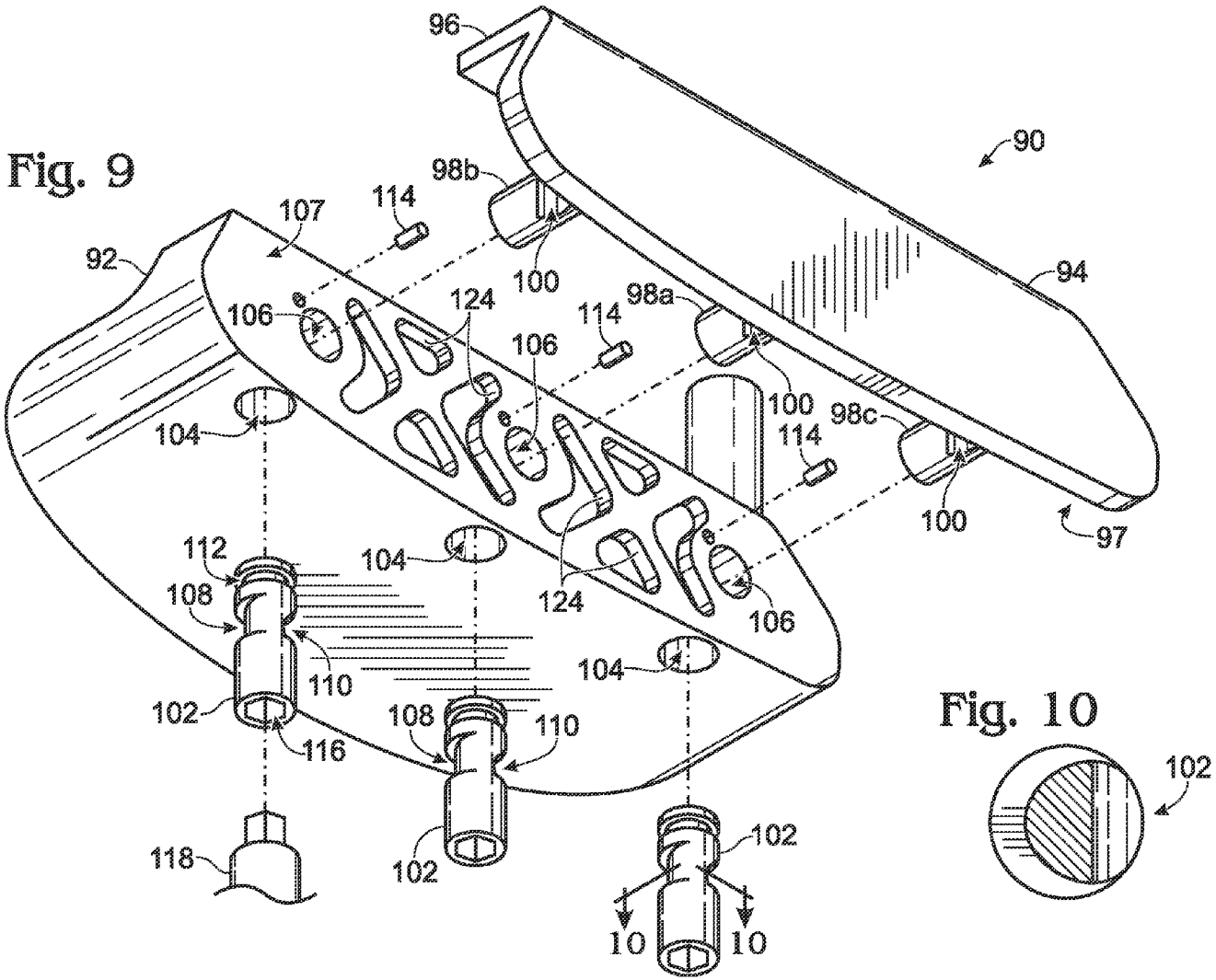
FIG. 9 is an exploded view of a putter according to another embodiment of the present invention.
FIG. 10 is a cross-section of a pin from FIG. 9.

FIGS. 9-17 depict yet another embodiment of the present invention in the form of a putter having an interchangeable faceplate and which conforms to USGA rules. Turning first to FIG. 9, a putter 90 is shown with a rear body portion 92 and a removable face portion 94. As shown, face portion 94 includes an upper lip 96 and an engagement surface 97 from which extend a plurality of detents 98. In the depicted embodiment, the putter face is secured to the rear body portion by three detents which are positioned across the length of the putter head. For example, one detent 98*a* is positioned in a relatively centrally located position and the two other detents are relatively positioned at the proximal 98*b* and distal 98*c* ends of the putter face (relative to the hosel and club shaft). The use of three engagement mechanisms positioned across the length of the putter head ensures that the face portion remains flush against the rear body portion even when the putter face strikes a golf ball off-center. This enables the putter to maintain the same feel and accuracy that could be achieved by an identically designed putter without a removable faceplate.

Figure 12:
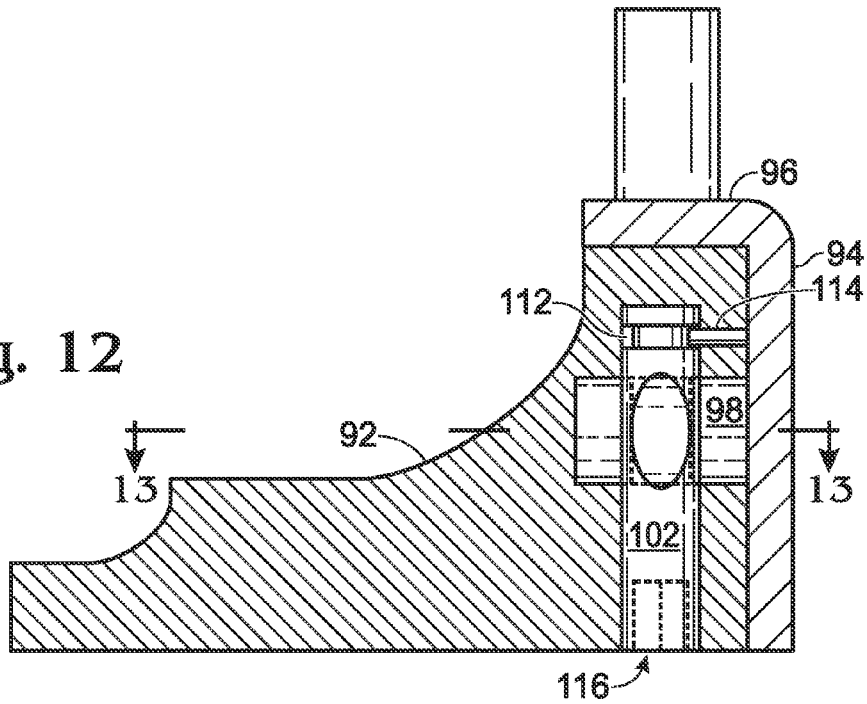
FIG. 12 is a cross section of the putter of FIG. 11.
Figure 13:
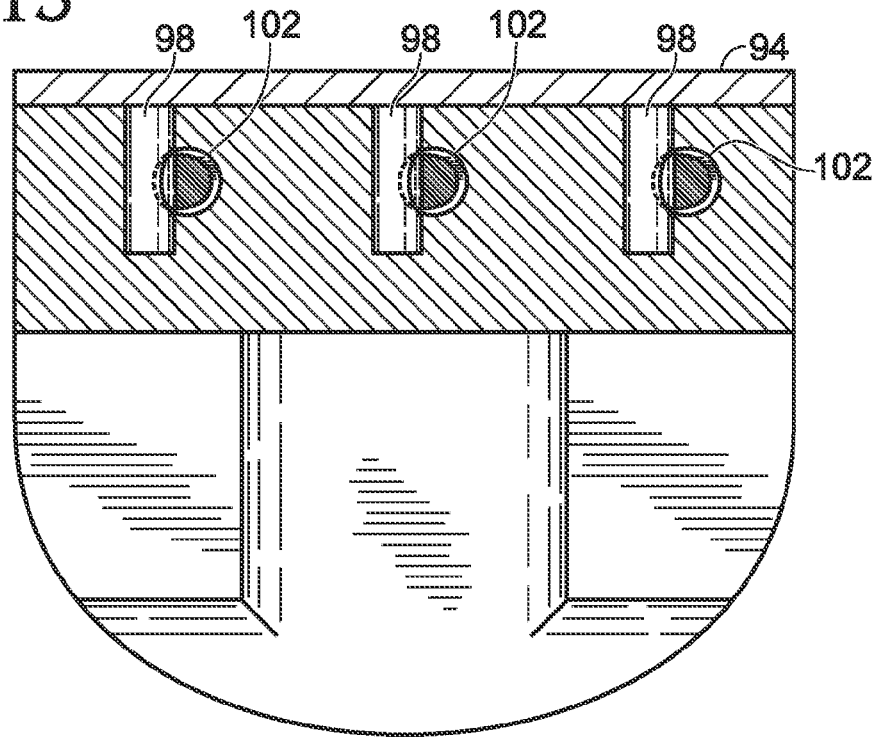
FIG. 13 is a cross-sectional top view of the putter of FIG. 12 showing the cams rotated into an open position such that the removable faceplate can be removed from the rear portion of the putter.
Figure 14:
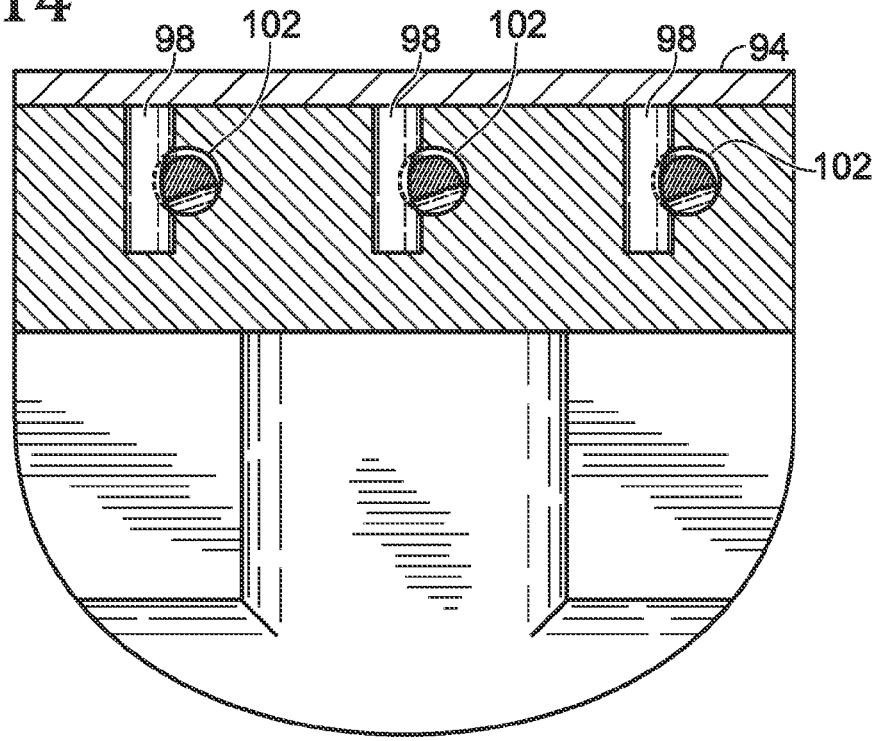
FIG. 14 is a cross-sectional top view of the putter of FIG. 12 showing the cams rotated into a locked position such that the removable faceplate is secured to the rear portion of the putter.

Each detent 98 includes an indentation 100 and is configured to reversibly mate with a cam 102. Rear body portion 92 includes a plurality of cams 102 which are secured within a recess in rear body portion 92 in such a manner that the cam is able to rotate within the recess so as to allow for the engagement and disengagement of detent 98 when the detent is inserted into rear body portion 92 (as shown in FIGS. 12-14). As shown, each cam 102 is seated within opening 104 and is accessible at the bottom of the putter. Rear body portion 92 includes openings 106 in engagement surface 107. Openings 106 are configured to receive detents 98 such that the detents can be reversibly engaged by cams 102.

Because access to the faceplate removal mechanism is on the bottom of the putter in this embodiment, the striking surface of faceplate 94 is completely smooth, again, helping to maintain the same feel and accuracy as an identically designed putter without a removable faceplate.

Viewing FIGS. 9-14 together, the center post of each cam 102 is offset and includes a shallow engagement groove 108 and an indentation 110. Faceplate 94 can be securely mated to rear portion 92 by inserting the detents 98 of faceplate 94 into recesses 106 of rear body portion 92 and rotating each cam 102 such that engagement groove 108 is seated within indentation 100 (See, e.g. FIG. 14). Faceplate 94 can be removed from rear portion 92 by rotating each cam 102 so that indentations 110 are aligned with indentations 110, thereby releasing detents 98 from cams 102 (See e.g. FIG. 13). As shown, cam 102 may include a circumferential groove 112 configured to be engaged by a pin 114 within rear body portion 92 so that cam 102 has free rotational movement but will not fall out of the putter head when faceplate 94 is removed.

According to USGA rules, a golf club cannot be used in tournament play if the structure of the club can be altered during the course of play. Accordingly, cam 102 may further include a tool engagement region 116, which may be engaged by a tool such as hex wrench 118. Because a separate tool, such as hex wrench 118 must be used to rotate cams 102 in order to remove and, if desired, exchange one faceplate for another, club 90 conforms to USGA rules.

Figure 11:
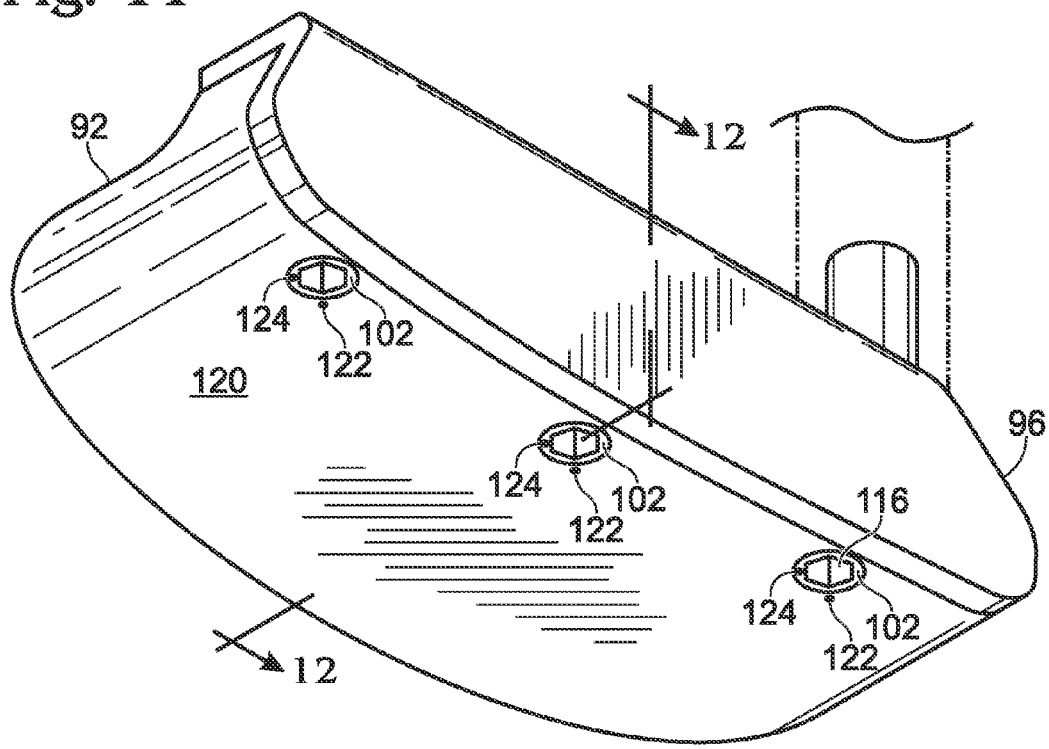
FIG. 11 depicts the putter of FIG. 9 showing the removable faceplace secured to the putter body.

Turning to FIG. 11, the bottom surface 120 of the putter may include alignment indicia 122, which are configured to align with alignment indicia 124 on cam 102 so indicate to a user whether the cam and putter face are in a locked or unlocked (i.e. removable) position.

The present disclosures also provides for a customizable putter fitting/design system, where regardless of the specific embodiment used, a single rear body portion maybe configured to mate with a plurality of different face portions and/or hosels with the same or different characteristics. Thus, the fitting system may include face portions providing different loft, material, weighting, etc.

Figure 15:
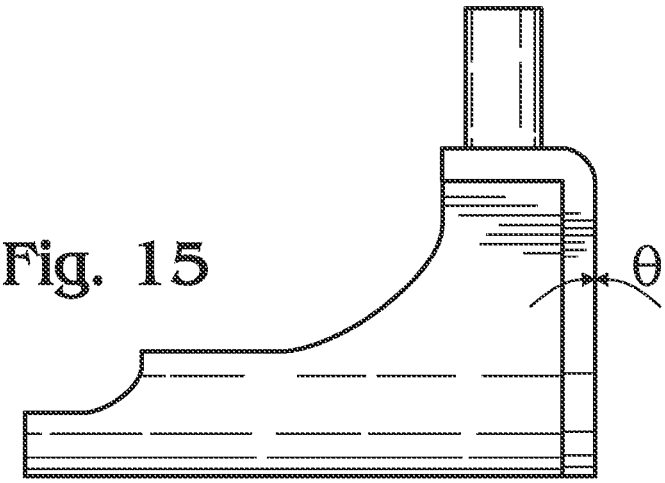
FIG. 15 is a side view of the putter of FIG. 9 showing the putter with a first faceplate having a first loft θ'.
Figure 16:
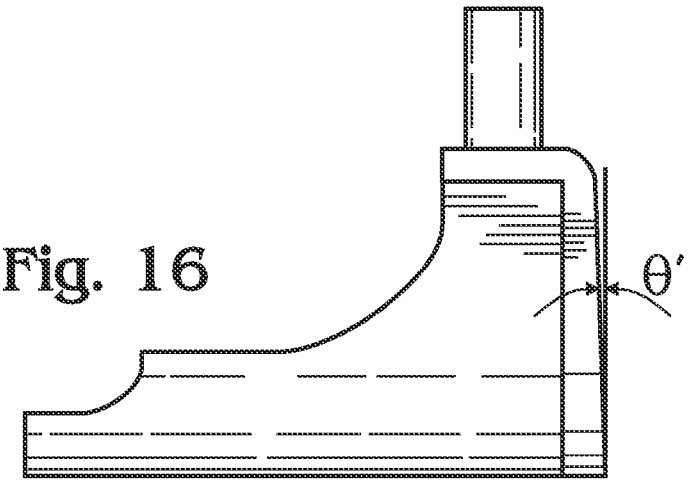
FIG. 16 is a side view of the putter of FIG. 9 showing the putter with a second faceplate having a second loft θ'.
Figure 17:
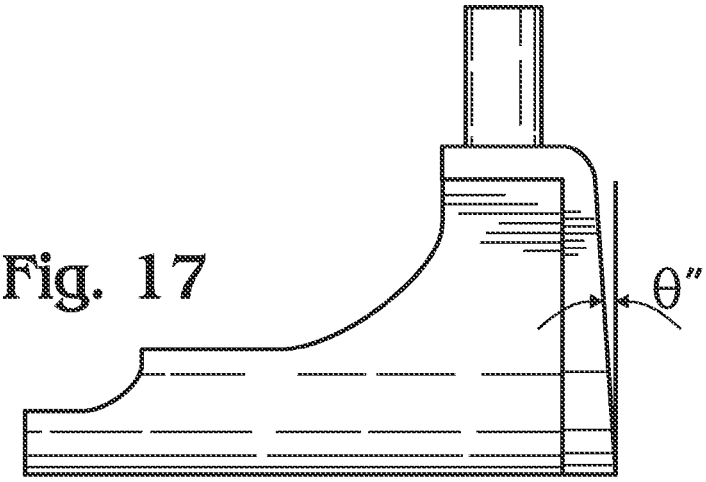
FIG. 17 is a side view of the putter of FIG. 9 showing the putter with a third faceplate having a third loft θ".

FIGS. 15-17 depict a putter, such as that shown in FIGS. 9-14 including face plates with differing lofts. In FIG. 15 the faceplate has a loft angle θ, in FIG. 15 the faceplate has a loft angle θ', and in FIG. 16 the faceplate has a loft angle θ". As non-limiting examples, θ might be 0°, θ' might be 2° and θ" might be 4°. Accordingly, during fitting, once a golfer has found a putter that has a particular feel, such as weight and style that he likes, a fitting professional could change out the faceplates to allow a golfer to try different lofts. Alternatively, or additionally, a golfer may wish to use putters with different lofts for different types of putting surfaces or conditions—i.e. different types of grass, different weather conditions, different stint meter readings, etc. Accordingly, instead of having to use an entirely different putter, a golfer could simply change the face plate to achieve the desired loft.

Alternatively or additionally, the fitting system may include two or more face portions formed from different types of materials. (Alternatively, only a portion of each face portion may include the different material.) For example, the fitting system may include a rear portion formed from steel, a first face plate formed from steel, and a second face plate formed from titanium or some other material having a specific gravity different from steel. Thus, by exchanging one face plate for another, the system provides for the alteration of the weighting, or moment of inertia, of the golf club.

Alternatively or additionally, the system may include a face portion having a striking surface including a reflective surface. The reflective surface may comprise all or only a portion of the putter face. It will be appreciated that the putter fitting system may include putter faces including any one or more of the above-described characteristics and that various combinations and sub-combinations of these or other logical differentiable characteristics, including both those of aesthetic (i.e. color or design) and utile nature are contemplated by the present invention.

Moreover, as previously described, the putter fitting system may include a plurality of different hosels. Hosels are known to differ in shape and design, and the use of such various hosels as are known is contemplated by the present invention. For example, without wishing to be limited to these designs, L-shaped, S-bend, and slant neck hosels are commonly known variations of hosel design.

Thus, the putter fitting system is able to provide a wide variety of adjustable features and the ability to quickly and easily find the putter set up that most favorably suits a particular golfer's style or the particular conditions encountered by the golfer. For example, the ability of the system to provide the above-described different characteristics in the putter without changing any other aspects of the club allows the golfer to alter this characteristic of the club to provide for better overall feel, or to customize the club for specific conditions—i.e., golf course set-up, type of grass, speed of the putting green, weather, etc.

Figure 8:
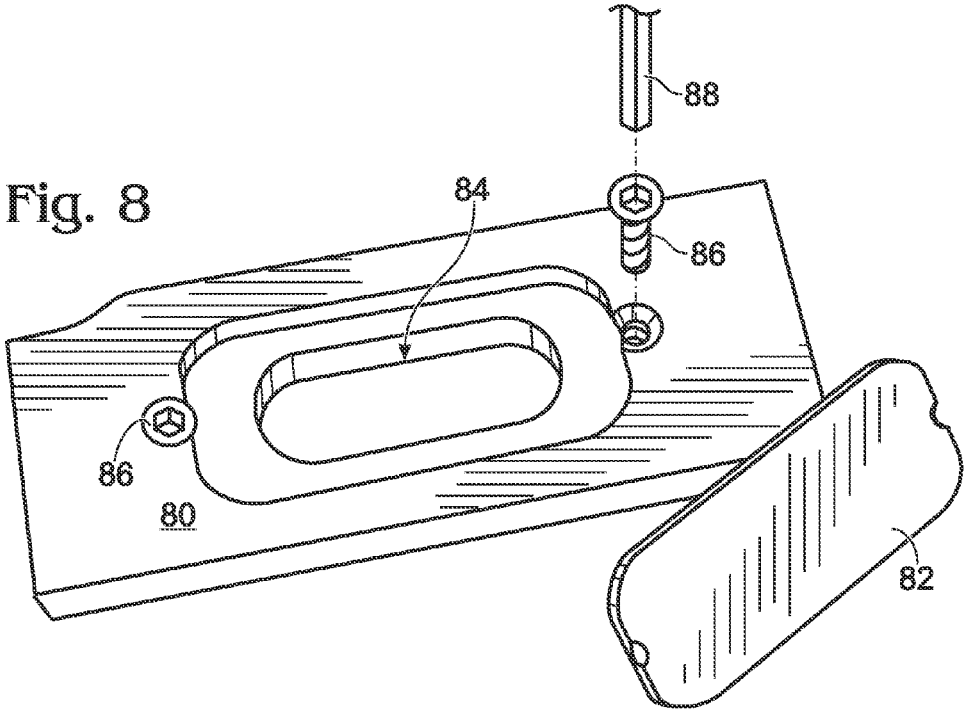
FIG. 8 is a close-up view of a putter face having an interchangeable insert.

As stated above, it may be desirable to provide a putter face where a portion of the face includes a reflective material. This may be accomplished through the use of a temporary or permanent face plate insert. One embodiment of a putter having a face plate insert is shown in FIG. 8. In the embodiment depicted, a face portion 80 includes an interchangeable insert 82. Insert 82 may be formed of a highly reflective material so as to act as a mirror, reflecting the image of the ball as it travels to and from the putter face. The interchangeable nature of the insert allows a golfer to use the putter a few times with the reflective surface and then change the insert to provide a non-reflective or substantially non-reflective surface more in keeping with the rest of the putter. Alternatively, inserts having other characteristics (i.e. weight, material, color, shape, etc.) may be used.

In the depicted embodiment, insert 82 may be seated into recess 84 and secured via screws 86 or other suitable means. Screws 86 may be tightened with wrench 88 or other suitable means. The seating of insert 82 into recess 84 allows the putter face to present a smooth and uniform surface when the insert is placed in the recess. This allows a golfer who is looking down on the putter when taking a putting stance to see a single, planar, putting surface. Moreover, any abrupt edges or angels that might result from the application of a removable surface to an already existing smooth putter face are significantly reduced or eliminated.

According to USGA rules, the striking surface of a club used in tournament play may not include holes. Returning to FIG. 9, it can be seen that the engagement surface 107 of rear body portion 92 includes a plurality of surface irregularities 124. Surface irregularities 124 may be incorporated to make surface 107 unsuitable for use as a striking surface, thereby ensuring that a faceplate 94 is attached to golf club 90 before it is used to strike a ball. In the depicted embodiment, surface irregularities 124 take the form of a negative X pattern machined into the face of rear portion 92. However, it will be appreciated that any surface irregularities that make engagement surface 107 unsuitable for use as a striking surface may be used including positive features such as nobs, nubs, raised portions, or the like and/or negative features including etched portions, pocks, holes, grooves, etc. and that such features may be placed in any desired pattern or randomly on the surface. However, it will be appreciated that various patterns may be used to provide various alterations in balance, weighting, or other desired characteristics.

It will be appreciated that rather than attaching the insert to the putter using screws, as shown, the insert may be glued or otherwise adhered to the putter face, in either a permanent or removable fashion.

Typically, the various parts of the putter and putter fitting system are machine milled from metal using the techniques commonly known and understood by those of skill in the art. However, it will be appreciated that some or all of the parts may be formed from any suitable materials including, but not limited to natural materials such as wood or man-made materials such as plastic.

While this disclosure has been described particularly in reference to putters it will be understood by those of skill in the art that the scope of the invention may encompass all golf clubs including, but not limited to, drivers, woods, irons, chippers, etc. Moreover, it will be appreciated that a wide variety of putter head styles are available and useful and that he present invention should not be limited to only the depicted styles.

It is believed that the disclosure set forth above encompasses multiple distinct inventions with independent utility.

While each of these inventions has been disclosed in its preferred form, the specific embodiments thereof as disclosed and illustrated herein are not to be considered in a limiting sense as numerous variations are possible. For example, the present disclosure contemplates a golf club with any combination of any of the removable faceplate mechanisms, removable hosel mechanisms or faceplate inserts described herein. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements and/or properties may be claimed in a related application. Such claims, whether they are directed to a different invention or directed to the same invention, whether different, broader, narrower or equal in scope to any original claims, are also regarded as included within the subject matter of the inventions of the present disclosure.

What is claimed is:

1. A putter including:

a removable face portion comprising a plurality of detents extending from an engagement surface wherein at least one detent is positioned towards the distal end of the putter body and one detent is positioned towards the proximal end of the putter body;

a rear body portion comprising: an engagement surface; a plurality of recesses in the engagement surface configured to receive the detents; and a faceplate engagement mechanism comprising: a plurality of cams positioned within the rear body portion such that when the detents are inserted into the recess, each detent is engagable by a cam; wherein each cam can be rotated from a first position, whereby the removable face portion is secured to the rear body port, to a second position, whereby the removable face portion is released and can be removed from the rear body portion; and wherein each cam comprises a tool engagement region which is accessible at the bottom surface of the putter.

2. The putter of claim 1 wherein the face portion comprises an upper lip that extends rearwards and fits flush against the rear portion to form a seamless face.

3. The putter of claim 1 wherein, when the faceplate is inserted into the rear body portion, the longitudinal axis of each cam is perpendicular to the longitudinal axis of each detent.

4. The putter of claim 1 further comprising a plurality of interchangeable face portions wherein each face portion is able to be secured to the rear body portion.

5. The putter of claim 4 wherein two or more of the face portions have different lofts.

6. The putter of claim 5 wherein the cam includes an engagement region that is accessible via the orifice in the club head.

7. The putter of claim 4 wherein two or more of the face portions are formed from different materials having different specific gravity.

8. The putter of claim 1 wherein a substantial portion of the engagement surface of said rear body comprises surface irregularities configured to make the surface unsuitable for use as a striking surface.

9. A putter comprising:

a removable faceplate comprising a plurality of detents extending from an inner engagement surface;

a rear body portion including an engagement surface comprising a plurality of recesses, wherein each recess is configured to receive a detent and wherein a substantial portion of the engagement surface comprises surface irregularities configured to make the engagement surface unsuitable for use as a striking surface wherein the rear body portion includes a faceplate securing mechanism comprising: a plurality of cams positioned within the rear body portion such that when the detents are inserted into the recess, each detent is engagable by a cam; wherein each cam can be rotated from a first position, whereby the removable face portion is secured to the rear body port, to a second position, whereby the removable face portion is released and can be removed from the rear body portion; and wherein each cam comprises a tool engagement region with is accessible at the bottom surface of the putter.

10. The putter of claim 9 wherein the faceplate securing mechanism is configured such that it can only be disengaged with the use of a separate tool.

11. The putter of claim 9 further comprising a plurality of interchangeable faceplates wherein at least two of the faceplates differ in loft angle.

12. A putter fitting kit comprising:

a plurality of different faceplates wherein each faceplate comprises a plurality of detents extending from an engagement surface;

a putter having a rear portion including a faceplate securing mechanism wherein the faceplate securing mechanism comprises a plurality of cams positioned within the rear body portion such that when each faceplate detent is inserted into a recess in an engagement surface in the rear portion, each detent is engagable by a cam; wherein each cam can be rotated with the use of a tool from a first position, where the removable face portion is secured to the rear body port, to a second position, where the removable face portion is released and can be removed from the rear body portion; and wherein each cam comprises a tool engagement region which is accessible at the bottom surface of the putter; and a faceplate removal tool configured to engage the tool engagement region of the cam and rotate the cam from the first position to the second position and vice versa.

13. The putter fitting kit of claim 12 wherein at least two of the different faceplates differ in loft angle.

* * * * *